United States Patent [19]

Girardi et al.

[11] Patent Number: 4,624,398

[45] Date of Patent: Nov. 25, 1986

[54] TAPE DISPENSING AND CUTTING RECEPTACLE

[76] Inventors: Michael J. Girardi; Marilyn A. Girardi, both of 48 Union Blvd., Wallington, N.J. 07057

[21] Appl. No.: 771,518

[22] Filed: Aug. 30, 1985

[51] Int. Cl.[4] ..... B26D 1/02

[52] U.S. Cl. ..... 225/21; 225/38; 225/52; 225/54; 225/82

[58] Field of Search ..... 225/21, 38, 52, 54, 225/82; 206/391; 242/55.42

[56] References Cited

U.S. PATENT DOCUMENTS 4,493,446 1/1985 Wirth ..... 225/38 X

*Primary Examiner*—James M. Meister

*Attorney, Agent, or Firm*—Melvin K. Silverman; Joseph A. Giampapa

[57] ABSTRACT

An improved tape dispenser/receptacle having complimentary oblong-shaped top and bottom portions adapted to mate with each other, wherein the improvement consists of: first and second spool-dispensing axes, each axes composed of ten pegs; longitudinally-oriented inner and outer sets of ridges, extending downward from underneath the device's top portion; a plurality of tape exist and flattening apertures; resilient tabs extending outward from the device's side walls, in one-to-one correspondence with the exit/flattening apertures; and a cutting surface. The spool-dispensing axes hold rolls of tape or other material which may be marked with identifying indicia. The inner ridges touch the radial surface of the tape rolls to keep the rolls from wobbling during dispensing, while the outer ridges act as means to keep the tape straight en route through the exit/flattening apertures. As the tape is pulled through the apertures, the resilient tabs act as a second guide-dispensing means to keep the tape straight prior to cutting, and subsequently, to return the tape edge after cutting to a convenient "ready-to-use" position.

7 Claims, 8 Drawing Figures

TAPE DISPENSING AND CUTTING RECEPTACLE

BACKGROUND OF THE INVENTION

1. Field of Invention

The present invention relates to tape dispensers and, more particularly, to a pocket-sized, hand-held, multiple-roll tape dispenser and cutting receptacle.

2. Summary of the Prior Art

In many instances, workmen, mechanics, repairmen or hobbyists face the intricate task of properly identifying or labelling a large number of discrete components. Electricians and telephone repairmen, in particular, face the problem of how to separate and identify multiple wire leads and lead pairs. Frequently, the solution to the problem is to employ color-coded, numbered or alphabetized tape onto the wires or other components. However, the environment in which such repairmen must work is often one where there is inadequate working space and poor lighting. In such an environment, there is need for a pocket-sized, hand-held, multiple-roll tape dispenser/receptacle unit from which the worker can quickly and easily extract the required marking or identifying materials.

Additionally, most manufacturing operations where component elements are repetitively assembled require the use of a device capable of facilitating the identification and labelling of parts. This is especially true in assembly lines that link electrical components to produce commercial and consumer durable goods.

Review of the prior art reveals the complete lack of such a device as described above.

U.S. Pat. No. 2,276,959 to Goldsmith reveals a Dispensing and Displaying Means for Narrow Fabrics, especially ribbon rolls. While Goldsmith's device is capable of accomodating multiple rolls of pre-wound material, it does not appear capable of embodiment within a pocket-sized hand-held unit, nor does it provide means for cutting selected lengths of pre-wound material as it is dispensed or displayed.

The spool holder of Chelbda, as described in U.S. Pat. No. 4,036,418, is also capable of holding a variety of spooled rolls. However, Chelbda's apparatus suffers the same shortcomings as Goldsmith in that the item is incapable of embodiment within a pocket-sized, hand-held unit, nor does it provide means for cutting selected lengths of the material spooled.

U.S. Pat. Nos. 2,710,151 to Delaney and 2,214,380 to Nisbet, respectively, disclose a Tape Roll & Holder and Storage and Dispensing Container for Shim Stock. Here again the devices can accomodate the need to dispense multiple rolls of pre-wound material, but neither is adaptable to a pocket-sized, hand-held unit, nor able to cleanly cut selected lengths of pre-wound material.

SUMMARY OF THE INVENTION

The present invention is an improved dispenser/-receptacle having oblong-shaped top and bottom portions adapted to complementarily mate with each other, wherein the improvement comprises the combination of:

(a) a plurality of spool-holding pegs each affixed to and extending from the floor of said bottom portion, said pegs respectively defining first and second spool-dispensing axes, with a plurality of tape rolls disposed upon said pegs in each of said axes;

(b) first and second longitudinally-oriented inner ridges depending from said upper portion, said ridges each defining a longitudinal axis, said ridges protruding in the direction of said pegs when said top portion is mated with said lower portion, said ridges touching the exposed radial surface of said tape rolls with a frictional contact sufficient to preclude unwanted wobbling of a corresponding tape roll during the dispensing thereof;

(c) first and second longitudinally-oriented outer ridges, comprising a first tape-dispensing guide means, said outer ridges disposed substantially parallel to said inner ridges and outward therefrom from said bottom and top portions;

(d) a plurality of tape exit and flattening apertures formed by the intersection of the perimeters of said bottom and top portions, in which tape from said spools is guided by said outer ridges through said exit and flattening apertures; and (e) second tape-dispensing guide means, comprising a plurality of resilient tab elements extending outwardly from the walls of said bottom portion in a direction transverse thereto, said second guide means acting to both properly orient the tape as it is being extended from the tape spools prior to cutting and acting to return said tape, after cutting, to a convenient next-cut position, as well as freeing said tape from a cutting surface of the inventive dispensing and cutting receptacle.

It is an object of the present invention to provide a pocket-sized, hand-held tape dispensing and cutting receptacle capable of easy and convenient use by field repairmen and assembly-line workers.

It is a further object of the invention to provide a tape dispensing and cutting receptacle that can accomodate multiple rolls of tape or other labelling material.

It is a yet further object to provide a unit that can cut selected lengths of tape or other labelling material cleanly, without tangling either the piece cut or the source roll, and can subsequently re-position the source roll away from the cutting means for its next use.

It is a still further object to provide a tape dispensing and cutting receptacle which contains maximum safety protection yet can be inexpensively produced.

Further objects and advantages of the present invention will become apparent from the hereinafter set forth Detailed Description of the Invention, the Drawings, and the Appended claims.

DETAILED DESCRIPTION OF THE PREFERRED EMBODIMENT

Figure 1:
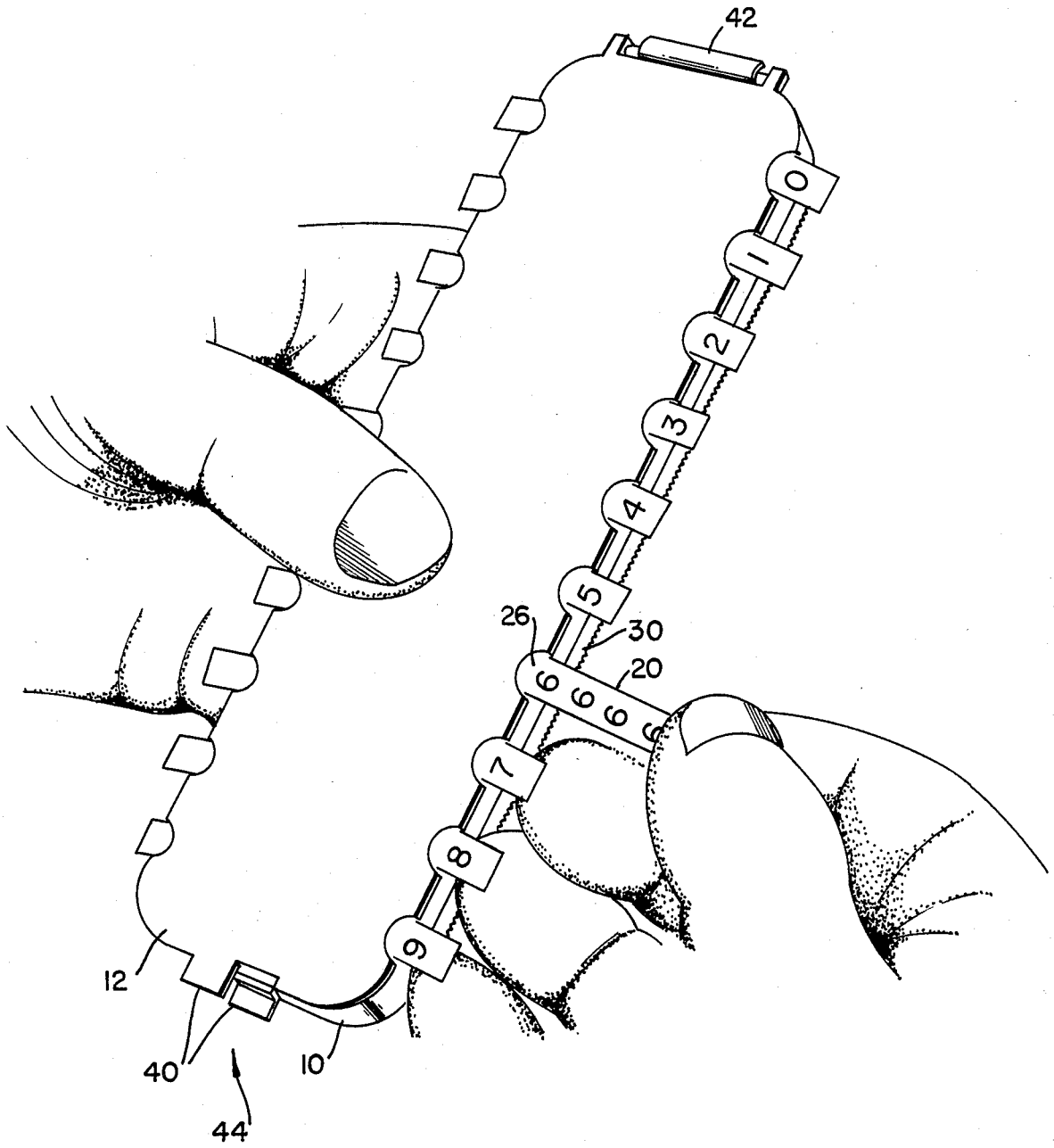
FIG. 1 is a perspective view of the inventive tape dispenser and cutting receptacle, as it is held by the user.

A clear understanding of the present dispenser/-receptacle can be gained from a glance at FIG. 1. Shown in perspective, slightly exploded view, one perceives a simple, pocket-sized, hand-held device capable of holding and dispensing up to twenty rolls of marking tape. As illustrated, the user has selected a tape roll 20 (#6, right side), has extended a desired length of tape from said roll through a corresponding tape exit and flattening aperture 26, and is about to pull the selected length of tape downward, at an angle against a cutting means 30, to remove the desired length of tape. Since FIG. 1 is an operational view, it shows the device's top portion, or cover 12, in the closed position opposite the bottom portion 10 (cutting means protective guards 32, 33 are not shown). Indicia such as numbers, letters or colors may be imprinted upon the labelling source material for added clarity and user convenience.

Figure 2:
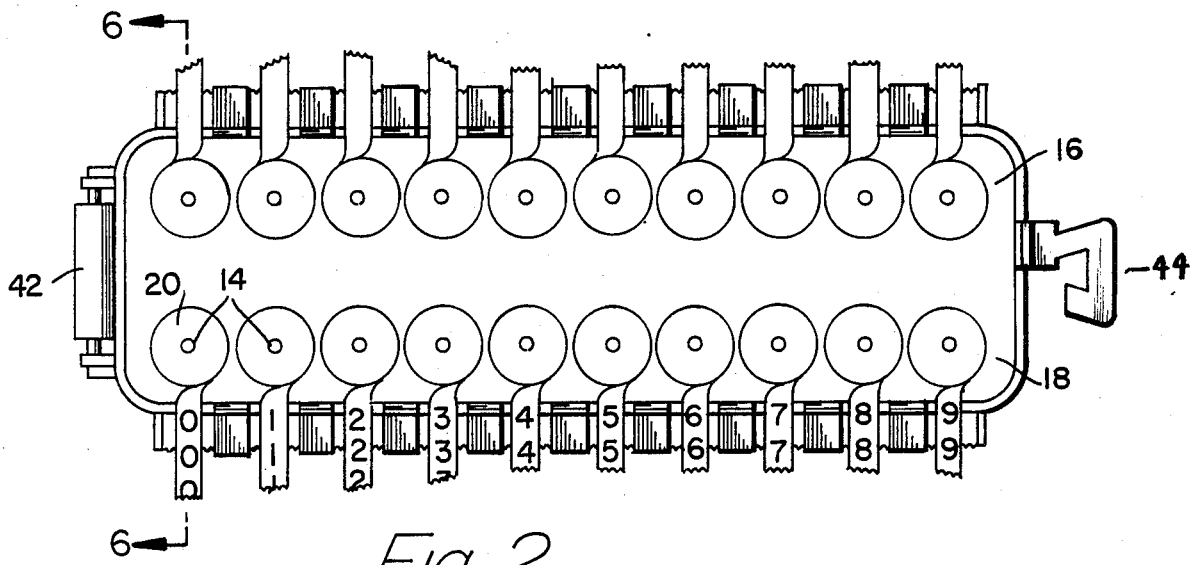
FIG. 2 is a top plan view of the dispenser/receptacle, shown absent the unit's cover and without the cutting guards.

Moving now to FIG. 2, looking downward into the guts of the unit and with the cover removed, there is a plurality of spool-holding pegs 14, each of which is affixed to and extends from the floor of the bottom portion 10 of the device. The plurality of spool-holding pegs 14, in the preferred embodiment ten to a side, define respectively first and second spool-dispensing axes 16, 18. A plurality of tape rolls 20, in one-to-one correspondence with the spool-holding pegs 14, are disposed upon said pegs 14. The bottom portion 10 serves as a storage tray for the tape rolls as well as a casing for the device. The tape configuration of FIG. 2 shows the tape edges in "ready" position; that is, extended slightly from the main bodies of the rolls so that a user can conveniently grab onto the edge to extract lengths of tape.

Figure 5:
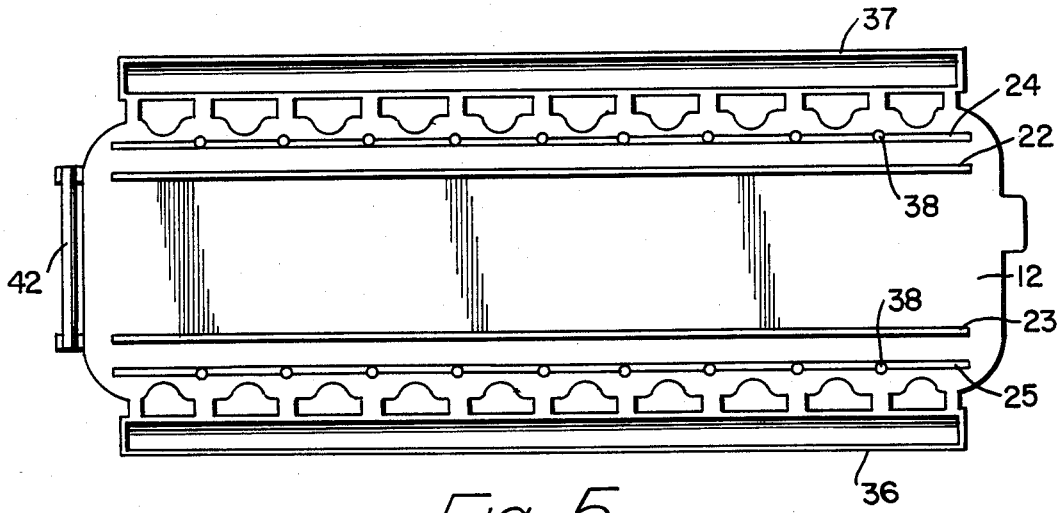
FIG. 5 is a view of the underneath side of the unit's cover, with the cutting guards in the open position, taken along Line 4—4 of FIG. 3.

Bearing down on the elements pictured in FIG. 2 is the underneath side of the dispenser/receptacle's top portion or cover. FIG. 5 illustrates the underneath side of the cover in specific detail. As is therein shown, the dispenser/receptacle contains first and second longitudinally-oriented inner ridges 22 and 23; and first and second longitudinally-oriented outer ridges 24 and 25. The purpose of the inner ridges is to hold the tape rolls or spooled material in place and prevent unwanted shifting or wobbling of the rolls. The outer ridges act as a first tape dispensing guide means to keep the tape or other material being unwound straight during unwinding. Naturally, the functions of the inner and outer ridges take effect only when the cover 12 is in its closed position resting atop the bottom portion 10.

Figure 6:
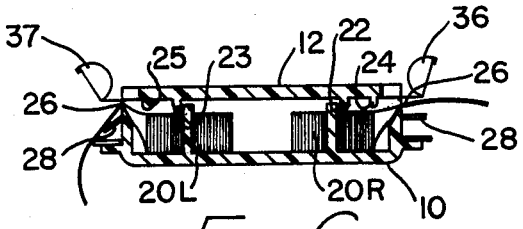
FIG. 6 is a cross-sectional view of the dispenser/-receptacle taken along Line 6—6 of FIG. 2. The tape roll on the left side is shown with a length of tape being cut, while the tape roll on the right hand side is in its retracted or "ready" position.

The functions of the inner and outer ridges, 22/23 and 24/25 respectively, are perhaps best illustrated in the cross-sectional view of FIG. 6. Note therein, tape from the tape roll on the right, 20R, is in the ready-to-use position while tape from the tape roll on the left, 20L, is shown as it is about to be cut. The difference between these two positions—the ready-to-use position of the tape roll on the right versus the about-to-be-cut position of the tape roll on the left—calls attention to the plurality of resilient tabs 28 extending outwardly from the walls of the device's bottom portion 10 in a direction transverse thereto. The purpose of these tabs 28 is threefold: (1) to bend downward and act as a second tape dispensing guide means properly orienting the tape as it is being extending from the tape spools prior to cutting; (2) to spring back after the tape has been cut, thereby returning the end of the tape to a convenient to use "next-cut" position; and (3) to free the tape or other source material from entanglement with the device's cutting edges. Also shown in FIG. 6, which view appears to capsulize the heart of the invention, is a plurality of tape exit and flattening apertures 26. These apertures are formed by the intersecting perimeters of the device's bottom 10 and top 12 portions, and work along with the outer ridges/guide means 24,25 to keep the tape or other material being unwound straight and flat during unwinding.

Figure 3:
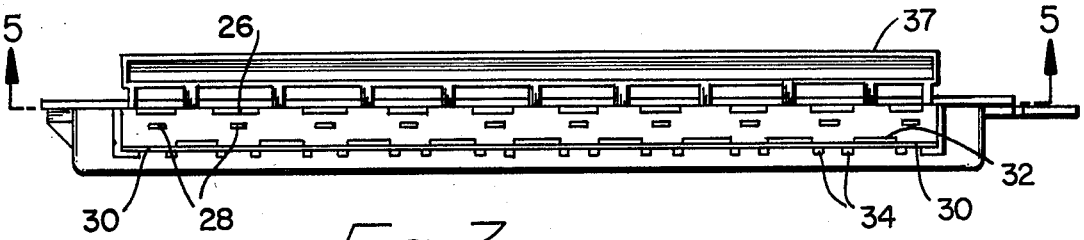
FIG. 3 is a side plan view of the dispenser/receptacle, with the cutting guards shown in the open position and absent any tape rolls.

FIG. 3, a side view of the dispenser/receptacle with cutting guards shown fully open, further illustrates the above-described pluralities of exit and flattening apertures 26 and resilient tabs 28. Below the row of tabs 28, at a fixed distance therefrom and at a fixed angle relative thereto, is means for snap-fitably receiving and securing longitudinal cutting means. In the preferred embodiment, the receiving and securing means is defined by the space between a plurality of upper cutting-holder elements 32 and a plurality of lower cutting-holder elements 34. The cutting means of the preferred embodiment is a jigsaw-toothed blade 30.

Figure 4:
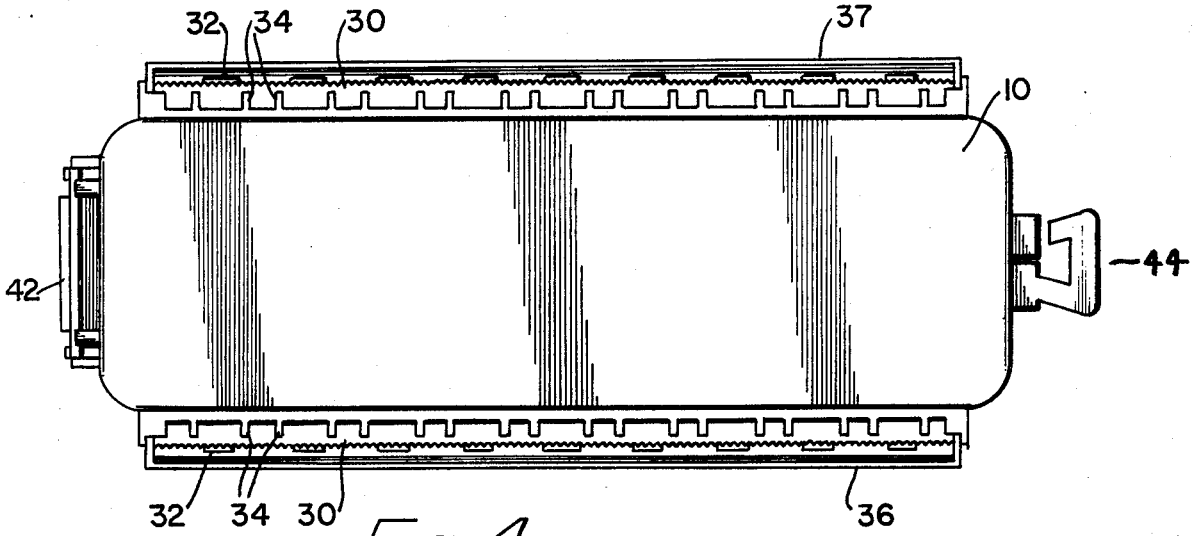
FIG. 4 is a bottom plan view of the dispenser/receptacle, the cutting guards again shown in the open position but with the unit fully loaded with tape.

FIG. 4, a bottom plan view of the dispenser/receptacle (cutting guards 36 and 37 shown half closed), illustrates the pluralities of upper cutting-holder elements 32 and lower cutting-holder elements 34, which thereby define means for receiving and securing the cutting surface, jigsaw blade 30.

Figure 7:
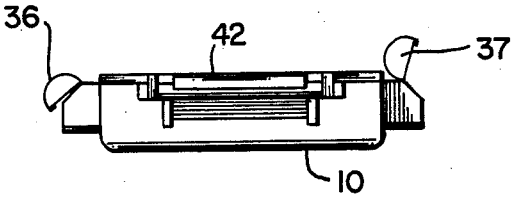
FIG. 7 is a rear end view of the dispenser/receptacle. Note that the cutting guards are shown one open and the other closed.
Figure 8:
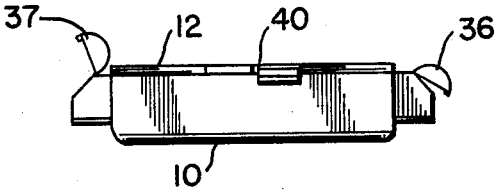
FIG. 8 is a front end view of the dispenser/receptacle. As in FIG. 7, the cutting guards are shown one open and the other closed.

In FIGS. 7 and 8, the means for complementarily mating the dispenser/receptacle's top portion 12 with its bottom portion 10 is highlighted. In the preferred embodiment, said mating means comprises side-by-side, counteropposed but complementary tabs 40 in the front of the device (see FIG. 8), and a bar/hinge joint 42 in the rear (see FIG. 7). An alternate embodiment additionally features a triangular hook 44 on the front securing means to enable the invention to be affixed to a repairmen's belt or other storage holder.

While the preferred embodiment of the invention has been shown and described, it will be understood that the invention may be embodied otherwise and that within such other embodiments, certain changes in the detail, construction and/or the form and arrangement of the parts may be made without departing from the underlying ideas or principles of this invention within the scope of the appended claims.

What we claim is:

1. An improved tape dispensing and cutting receptacle having oblong-shaped top and bottom portions adapted to complementarily mate with each other, wherein the improvement comprises the combination of:

(a) a plurality of spool-holding pegs each affixed to and extending from the floor of said bottom portion, said pegs respectively defining first and second spool-dispensing axes, with a plurality of tape rolls disposed upon said pegs in each of said axes;

(b) first and second longitudinally-oriented inner ridges depending from said upper portion, said ridges each defining a longitudinal axis, said ridges protruding in the direction of said pegs when said top portion is mated with said lower portion, said ridges touching the exposed radial surface of said tape rolls with a frictional contact sufficient to preclude unwanted wobbling of a corresponding tape roll during the dispensing thereof;

(c) first and second longitudinally-oriented outer ridges, comprising a first tape-dispensing guide means, said outer ridges disposed substantially parallel to said inner ridges and outward therefrom from said bottom and top portions;

(d) a plurality of tape exit and flattening apertures formed by the intersection of the perimeters of said bottom and top portions, in which tape from said spools is guided by said outer ridges through said exit and flattening apertures; and (e) second tape-dispensing guide means, comprising a plurality of resilient tab elements extending outwardly from the walls of said bottom portion in a direction transverse thereto, said second guide means acting to both properly orient the tape as it is being extended from the tape spools prior to cutting and acting to return said tape, after cutting, to a convenient next-cut position, as well as freeing said tape from a cutting surface of the inventive dispensing and cutting receptacle.

2. The dispenser/receptacle as recited in claim 1 further comprising:

means for snap-fitably receiving and securing longitudinal cutting means, said cutting means disposed at a desired distance from, and relative angle to, both said bottom portion and said second tape guide means.

3. The dispenser/receptacle as recited in claim 2 in which said longitudinal cutting means comprises a jigsaw blade.

4. The dispenser/receptacle as recited in claim 2 in which said top portion is provided with a plurality of windows through which indicia imprinted upon said tape may be observed by a user of the device.

5. The dispenser/receptacle as recited in claim 2 further comprising:

protective cover guards for said cutting means, said cover guards formed longitudinally integral with the side walls of said top portion, for rotational snap-fit securement onto and about said cutting means.

6. The dispenser/receptacle as recited in claim 2 further comprising:

hook means disposed at the front end of said dispenser/receptacle, said hook means providing a convenient means for storing and carrying the device.

7. An improved tape dispensing and cutting receptacle having oblong-shaped top and bottom portions adapted to complementarily mate with each other, wherein the improvement comprises the combination of:

(a) a plurality of spool-holding pegs each affixed to and extending from the floor of said bottom portion, said pegs respectively defining first and second spool-dispensing axes, with a plurality of tape rolls disposed upon said pegs in each of said axes;

(b) first and second longitudinally-oriented inner ridges depending from said upper portion, said ridges each defining a longitudinal axis, said ridges protruding in the direction of said pegs when said top portion is mated with said lower portion, said ridges touching the exposed radial surface of said tape rolls with a frictional contact sufficient to preclude unwanted wobbling of a corresponding tape roll during the dispensing thereof;

(c) first and second longitudinally-oriented outer ridges, comprising a first tape-dispensing guide means, said outer ridges disposed substantially parallel to said inner ridges and outward therefrom from said bottom and top portions;

(d) a plurality of tape exit and flattening apertures formed by the intersection of the perimeters of said bottom and top portions, in which tape from said spools is guided by said outer ridges through said exit and flattening apertures; and (e) second tape-dispensing guide means, comprising a plurality of resilient tab elements extending outwardly from the walls of said bottom portion in a direction transverse thereto, said second guide means acting to both properly orient the tape as it is being extended from the tape spools prior to cutting and acting to return said tape, after cutting, to a convenient next-cut position, as well as freeing said tape from a cutting surface of the inventive dispensing and cutting receptacle;

wherein the length of said dispenser/receptacle is in the range of 15.0 centimeters to 17.5 centimeters, the width of said dispenser/receptacle is in the range of 5.0 centimeters to 6.5 centimeters, and the height of said dispenser/receptacle is in the range of 1.5 centimeters to 2.0 centimeters.

* * * * *